US010139100B2

(12) United States Patent
Yim et al.

(10) Patent No.: US 10,139,100 B2
(45) Date of Patent: Nov. 27, 2018

(54) SPEAKER INCLUDING A SPEAKER APPARATUS AND A LIGHTING APPARATUS

(71) Applicant: SAMSUNG ELECTRONICS CO., LTD., Suwon-si (KR)

(72) Inventors: Hong Kyun Yim, Suwon-si (KR); Sung Jin Ann, Seoul (KR); Sin Wi Moon, Seogwipo-si (KR); Eun Lee, Yongin-si (KR); Yu Li Sung, Goyang-si (KR); Young Soo Hong, Goyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/676,431

(22) Filed: Aug. 14, 2017

(65) Prior Publication Data

US 2017/0343207 A1 Nov. 30, 2017

Related U.S. Application Data

(63) Continuation of application No. 14/147,791, filed on Jan. 6, 2014, now Pat. No. 9,765,959.
(Continued)

(30) Foreign Application Priority Data

Jun. 28, 2013 (KR) ..... 10-2013-0075125

(51) Int. Cl.
*F21V 33/00* (2006.01)
*H04R 1/02* (2006.01)

(52) U.S. Cl.
CPC ..... *F21V 33/0056* (2013.01); *H04R 1/028* (2013.01)

(58) Field of Classification Search
None
See application file for complete search history.

(56) References Cited

U.S. PATENT DOCUMENTS 2,501,968 A 3/1950 Sassin
3,194,952 A 7/1965 Wells
(Continued)

FOREIGN PATENT DOCUMENTS

CN 1327703 A 12/2001
CN 2744111 Y 11/2005
(Continued)

OTHER PUBLICATIONS

Communication dated Aug. 24, 2016, issued by the Australian Patent Office in counterpart Australian Application No. 2014204207.
Communication dated Dec. 27, 2016, issued by the Russian Patent Office in counterpart Russian application No. 2015126772/28(041663).
(Continued)

*Primary Examiner* — Ahn Mai
*Assistant Examiner* — Zachary J Snyder
(74) *Attorney, Agent, or Firm* — Sughrue Mion, PLLC

(57) ABSTRACT

A speaker includes a speaker apparatus configured to generate sound and provided with a coned shaped vibration portion; and a lighting apparatus inserted through the vibration portion and disposed at a center of the vibration portion to emit light to the vibration portion. The lighting apparatus includes: a lighting module having a light emitting device; and a light diffusion portion configured to surround the lighting module in order to diffuse light generated from the light module toward the vibration portion.

19 Claims, 13 Drawing Sheets

Related U.S. Application Data

(60) Provisional application No. 61/748,931, filed on Jan. 4, 2013.

(56) References Cited

U.S. PATENT DOCUMENTS

| | | | | |
|---|---|---|---|---|
| 5,174,645 | A | 12/1992 | Chung | |
| 7,123,738 | B1 * | 10/2006 | Mizone | F21S 10/02 381/333 |
| 8,891,807 | B2 * | 11/2014 | Gleißner | H04R 1/028 381/164 |
| 2004/0175014 | A1 * | 9/2004 | Liu | F21V 33/0056 381/386 |
| 2007/0003100 | A1 | 1/2007 | Liu | |
| 2008/0285257 | A1 | 11/2008 | King | |
| 2009/0067663 | A1 | 3/2009 | Ivey et al. | |
| 2009/0279302 | A1 | 11/2009 | Lee | |
| 2009/0279305 | A1 * | 11/2009 | Lee | G02B 5/045 362/296.01 |
| 2010/0195861 | A1 | 8/2010 | King | |
| 2011/0286200 | A1 | 11/2011 | Iimura et al. | |
| 2012/0087520 | A1 | 4/2012 | Harwood et al. | |
| 2012/0230499 | A1 | 9/2012 | Suzuki et al. | |

FOREIGN PATENT DOCUMENTS

| | | | |
|---|---|---|---|
| DE | 102010062300 | A1 | 6/2012 |
| JP | 566182 | U | 1/1981 |
| JP | 02-47887 | U | 4/1990 |
| JP | 2000-217185 | A | 8/2000 |
| JP | 2002184221 | A | 6/2002 |
| JP | 2003-23693 | A | 1/2003 |
| JP | 2005-252424 | A | 9/2005 |
| JP | 2006-148503 | A | 6/2006 |
| JP | 2006148503 | A | 6/2006 |
| JP | 3147181 | U | 12/2008 |
| JP | 2009-170321 | A | 7/2009 |
| JP | 2010-129300 | A | 6/2010 |
| JP | 2010157653 | A | 7/2010 |
| JP | 2010182540 | A | 8/2010 |
| WO | 2010089837 | A1 | 8/2010 |
| WO | 2012/072622 | A1 | 6/2012 |

OTHER PUBLICATIONS

Communication dated Jan. 13, 2017, issued by the Mexican Patent Office dated in counterpart Mexican application No. MX/a/2015/008545.

Communication dated Jul. 12, 2016, issued by the Russian Patent Office in counterpart Russian Application No. 2015126772/28(041663).

International Search Report dated Mar. 31, 2014, from the International Searching Authority in counterpart International Application No. PCT/KR2014/000056.

Japanese Office dated Mar. 9, 2017, issued in coupterpart Japanese Application No. 2015-551602.

Communication dated Jul. 18, 2017, issued by the Russian Intellectual Property Office in counterpart application No. 2015126772.

Communication dated Jan. 26, 2016 by the European Patent Office in related Application No. 15190311.9.

Communication, Issued by the European Patent Office, dated Sep. 18, 2014, In counterpart European Application No. 14150168.4.

Communication dated Jul. 26, 2016, issued by the Japanese Patent Office in counterpart Japanese Application No. 2015-551602.

Communication dated May 30, 2016, issued by the Mexican Patent Office in counterpart Mexican Application No. MX/a/2015/008545.

Communication dated Aug. 23, 2016, issued by the Mexican Patent Office in counterpart Mexican Application No. MX/a/2015/008545.

Communication dated Sep. 20, 2016, issued by the Republic of South African Patent Office in counterpart South African Application No. 2015/04668.

Communication dated Nov. 3, 2016, issued by the European Patent Office in counterpart European Application No. 5190311.9.

Communication dated Nov. 3, 2017, issued by the State Intellectual Property Office of P.R. China in counterpart Chinese Application No. 201410005172.8.

Communication dated Nov. 21, 2017, issued by the Japanese Patent Office in counterpart Japanese Application No. 2015-551602.

Communication dated Jun. 5, 2018, issued by the State Intellectual Property Office of the People's Republic of China in counterpart Chinese Patent Application No. 201410005172.8.

Communication dated Mar. 15, 2018, issued by the Federal service for intellectual property in counterpart Russian Patent Application No. 2015126772/28.

* cited by examiner

SPEAKER INCLUDING A SPEAKER APPARATUS AND A LIGHTING APPARATUS

CROSS-REFERENCE TO RELATED APPLICATIONS

This application is a continuation application of U.S. application Ser. No. 14/147,791 filed Jan. 6, 2014, which claims priority from Korean Patent Application No. 10-2013-0075125, filed on Jun. 28, 2013, and U.S. Provisional Patent Application No. 61/748,931, filed on Jan. 4, 2013, the disclosures of which are incorporated herein by reference, in their entireties.

BACKGROUND

1. Technical Field

The exemplary embodiments relate to a speaker provided with a lighting apparatus configured to emit light to a speaker vibration portion.

2. Description of the Related Art

In general, a speaker represents an acoustic device configured to copy sound wave by converting electrical signals output from an audio amplifier into vibration for a vibration part such that a compression-rarefaction wave is generated in the air. The speaker includes various types of speakers, such as a magnetic speaker, a dynamic speaker, a condenser speaker, a piezoelectric speaker and a ceramic speaker, divided depending on the way they are operated.

The speaker of the related art is a device configured to output sound by vibrating the vibration part up and down, in response to electrical signals received from an amplifier, to provide an acoustic effect.

That is, a speaker of the related art only has a function of outputting an acoustic signal, and is provided in substantially the same external appearance, thereby leading to lower satisfaction to a user having various demands, in particular, for a visual effect.

In order to resolve such drawbacks, a speaker having an outer side thereof with a lamp is provided, so that aesthetic quality is improved. However, the lamp itself may block light and thus degrade the lighting efficiency.

SUMMARY

Therefore, it is an aspect of the exemplary embodiments to provide a speaker capable of diffusing and reflecting light toward a vibration part, by way of a lighting apparatus.

Additional aspects will be set forth in part in the description which follows and, in part, will be obvious from the description, or may be learned by practice of the disclosure.

In accordance with one aspect of the exemplary embodiments, a speaker includes a speaker apparatus and a lighting apparatus. The speaker apparatus may be configured to generate sound and be provided with a vibration portion having a cone shape. The lighting apparatus may be insertedly disposed at a center of the vibration portion to emit light to the vibration portion.

The speaker may further include a mounting portion provided on the center of the vibration portion. The lighting apparatus may be mounted on the mounting portion.

The lighting apparatus may include a lighting module having a light emitting device, and a light diffusion portion configured to surround the lighting module in order to diffuse light generated from the light module toward the vibration portion.

The light diffusion portion may include a prism whose outer surface is curved to allow light generated from the lighting module to reach the vibration portion through dispersion or refraction.

The light diffusion portion may include a concave convex part provided in the shape of a column whose outer surface is formed in a concave convex structure.

The concave convex part may include a ventilation hole to radiate heat generated by the light emitting device. The ventilation hole may be provided at an inner side of the concave/convex part.

The concave convex part may include a convex portion formed in a protruding manner, and a concave portion depressed when compared to the convex portion, while being formed adjacent to the convex portion. One of the convex part and the concave portion may be opaque, and the remaining portion may be transparent.

The lighting apparatus may further include a support portion allowing a lower portion of the light diffusion portion to be mounted thereon, the support portion being configured to be mounted and fixed to the center of the vibration portion.

The support portion may include heat resistant material.

The support portion may include a support tube having a wire hole allowing a wire transmitting electrical signals to the light emitting device to pass there though.

The lighting apparatus may include a cover, at an inner side of which the lighting module is mounted, and which is configured to cover the light diffusion portion having a hollow part.

The light emitting device may be disposed on a virtual axial line passing through the center of the vibration portion.

The lighting apparatus may further include a refraction member provided at an inside the light diffusion portion, the refraction member having a center thereof protruding while having a curved surface, so as to diffuse light generated from the lighting module toward the vibration portion.

The lighting module may be provided at an upper end of the lighting diffusion portion. The refraction member may be disposed at a lower end of the lighting diffusion portion while having the protrusion portion disposed in a same direction as a light radiating direction of the lighting module, the refraction member including material available for light reflection.

The lighting module may be provided at an upper end of the light diffusion portion. The refraction member may cover the lighting module while having the protrusion provided in a same direction as a light radiating direction of the lighting module, the refraction member including material allowing light to pass and reflect there through.

The lighting module may be provided at a lower end of the lighting diffusion portion. The refraction member may be disposed at an upper end of the lighting diffusion portion while having the protrusion disposed in an opposite direction to a light radiating direction of the lighting module, the refraction member including material available for light reflection.

The speaker apparatus may include a magnetic circuit part and a vibration meter. The magnetic circuit part may form a magnetic circuit while including a magnet, an upper plate provided at an upper side of the magnet, a lower plate provided at a lower side of the magnet, and a pole piece disposed in a center of the magnet. The vibration meter may be configured to generate vibration in the vibration portion by interacting with the magnetic circuit part, the vibration meter having a voice coil provided between the magnet and the pole piece and a bobbin on which the voice coil is installed.

In accordance with another aspect of the exemplary embodiments, a speaker includes a magnetic circuit part, a vibration meter and a lighting apparatus. The magnetic circuit part may form a magnetic circuit while including a magnet, an upper plate provided at an upper side of the magnet, a lower plate provided at a lower side of the magnet, and a pole piece disposed in a center of the magnet. The vibration meter may be configured to be movable by the magnetic circuit formed by the magnetic circuit part, the vibration member having a voice coil provided between the magnet and the pole piece to interact with the magnetic circuit part, a bobbin on which the voice coil is installed and which moves in an axial direction, and a vibration portion configured to generate sound by generating vibration from movement of the bobbin. The lighting apparatus may be insertedly installed in a center of the vibration portion so as to radiate light to the vibration portion.

The lighting apparatus may be fixedly mounted on an upper portion of the pole piece.

The lighting apparatus may include a lighting module having a light emitting device, and a light diffusion portion provided around the lighting module while having at least one portion thereof including light transmitting material so as to diffuse light generated from the lighting module to the vibration portion.

The light diffusion portion may have a concave convex part provided with a concave convex structure formed at a circumference thereof. The light diffusion portion being provided in a cylindrical form having a hollow portion.

The lighting apparatus may further include a support part including a fixing part to which one side of the light diffusion portion is fixedly mounted, and a support tube inserted into a through hole provided in the pole piece and having a wire hole which corresponds to a hollow portion extending to the fixing part so as to allow a wire transmitting an electrical signal to the lighting module to pass there through.

The support may be provided to allow the magnetic circuit part to be spaced apart from the light diffusion portion.

The support may include heat resistant material.

An aspect of an exemplary embodiment may provide a speaker including: a speaker apparatus configured to generate sound and provided with a vibration portion; and a lighting apparatus insertedly disposed at a center of the vibration portion to emit light to the vibration portion, wherein the lighting apparatus includes: a lighting module having a light emitting device; and a light diffusion portion configured to surround the lighting module in order to diffuse light generated from the light module toward the vibration portion, wherein the light diffusion portion allows light generated from the lighting module to reach the vibration portion through dispersion or refraction.

The speaker apparatus may be cone shaped, and the light diffusion portion may include a prism with a curved outer surface.

The light diffusion portion may include a concave convex part provided in a column shape wherein the concave convex part may be provided in a column shape including: a convex portion formed in a protruding manner; and a concave portion depressed when compared to the convex portion, while being formed adjacent to the convex portion.

One of the convex portion and the concave portion may be opaque, and the remaining portion may be transparent.

As apparent from the above, the speaker is provided with the light apparatus installed so as to radiate light toward the speaker vibration portion, and to produce light motion according to the strength and weakness of acoustic signal, thereby producing a visual sound effect.

BRIEF DESCRIPTION OF THE DRAWINGS

These and/or other aspects of the exemplary embodiments will become apparent and more readily appreciated from the following description taken in conjunction with the accompanying drawings of which.

DETAILED DESCRIPTION OF THE EXEMPLARY EMBODIMENTS

Figure 1:
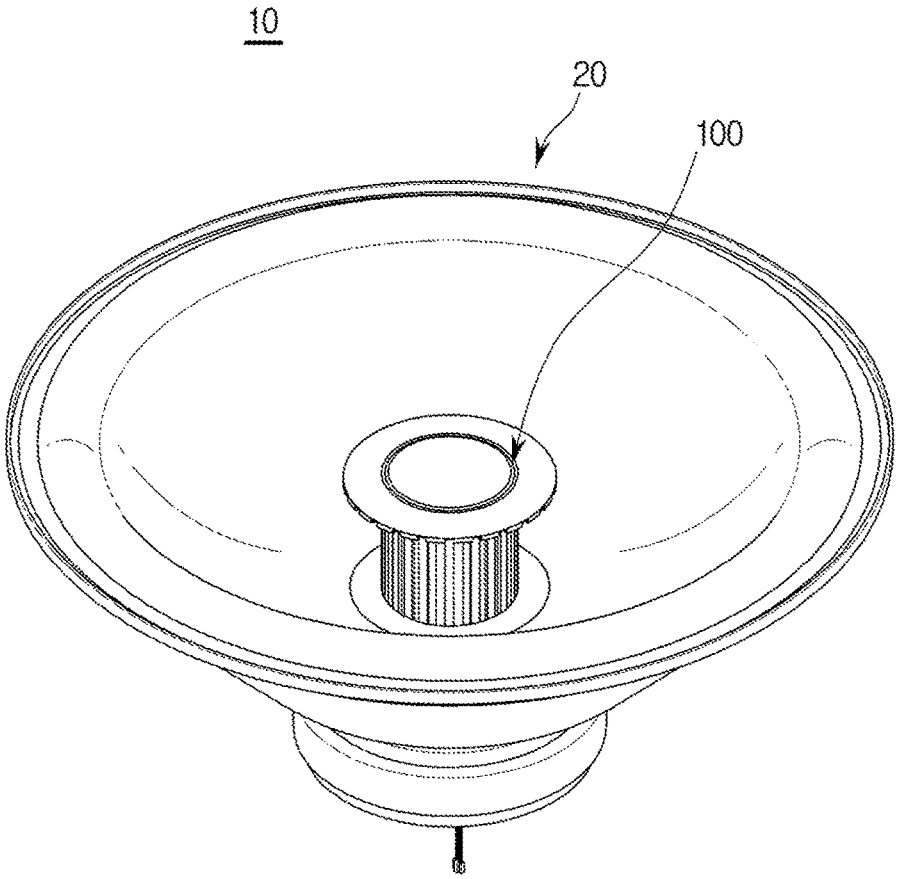
FIG. 1 is a perspective view which illustrates a speaker in accordance with an exemplary embodiment.

Reference will now be made in detail to the exemplary embodiments examples of which are illustrated in the accompanying drawings, wherein like reference numerals refer to like elements throughout.

Figure 2:
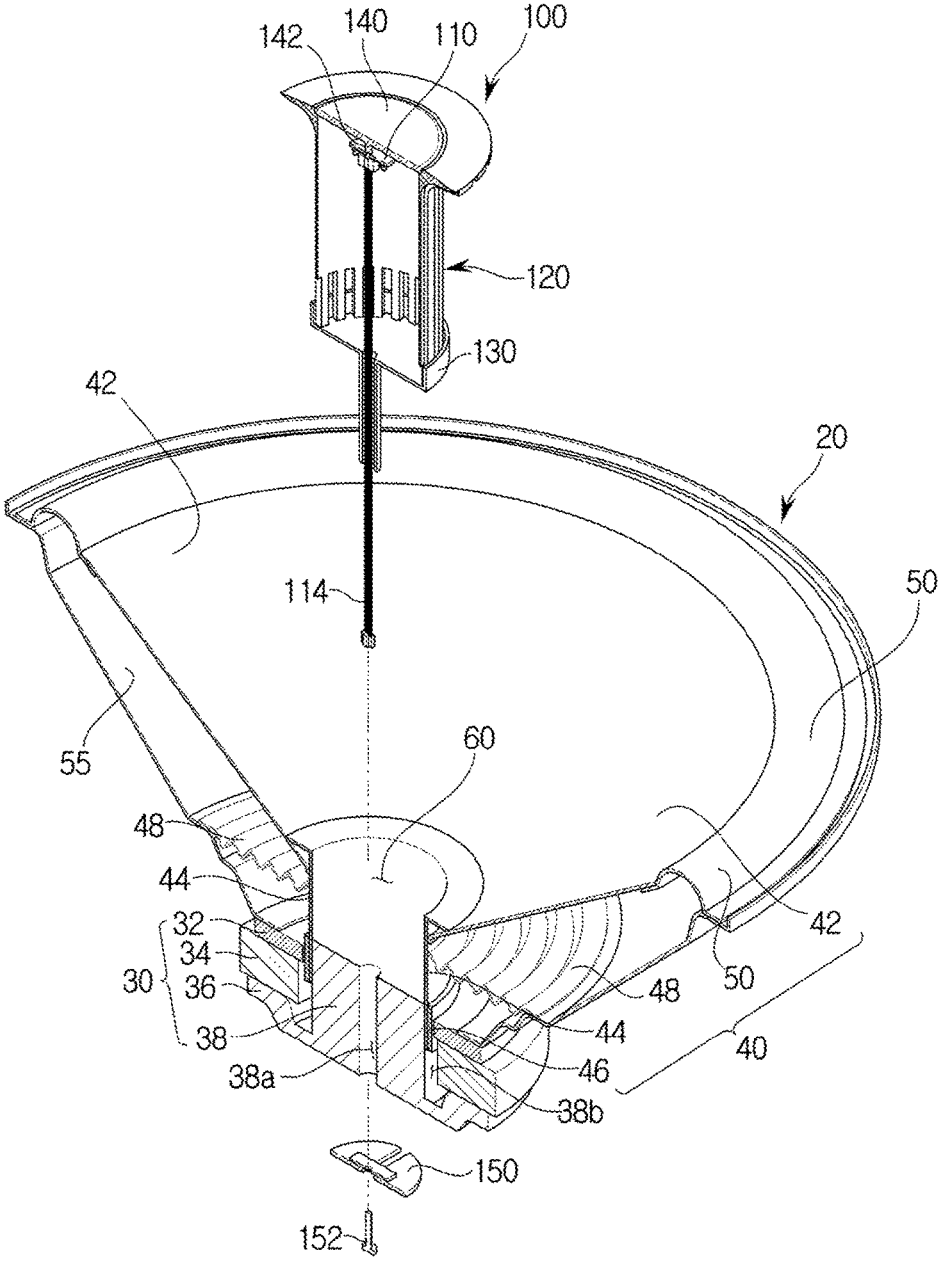
FIG. 2 is an exploded cross sectional view which illustrates the speaker in accordance with an exemplary embodiment.
Figure 3:
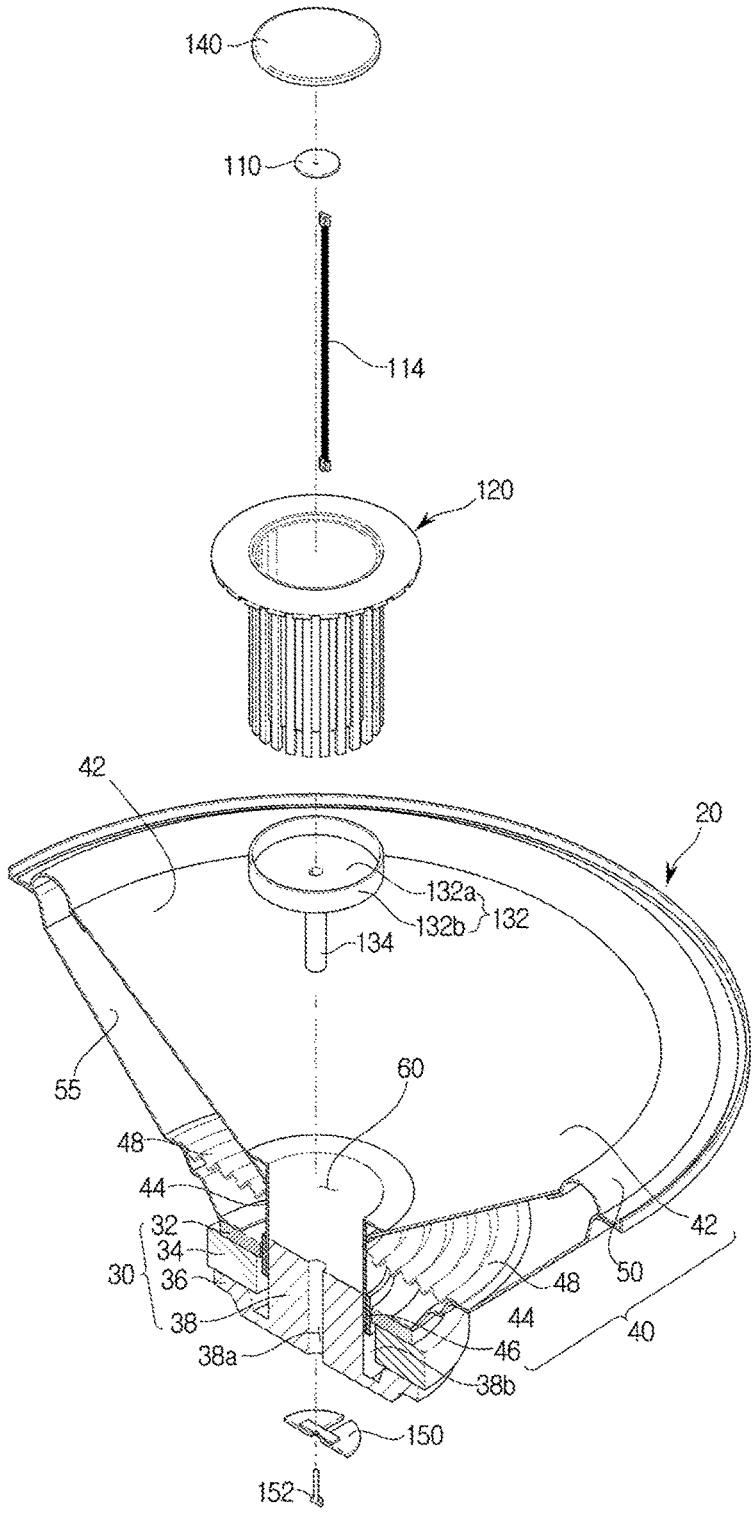
FIG. 3 is an exploded cross sectional view which illustrates the speaker in accordance with an exemplary embodiment.
Figure 4:
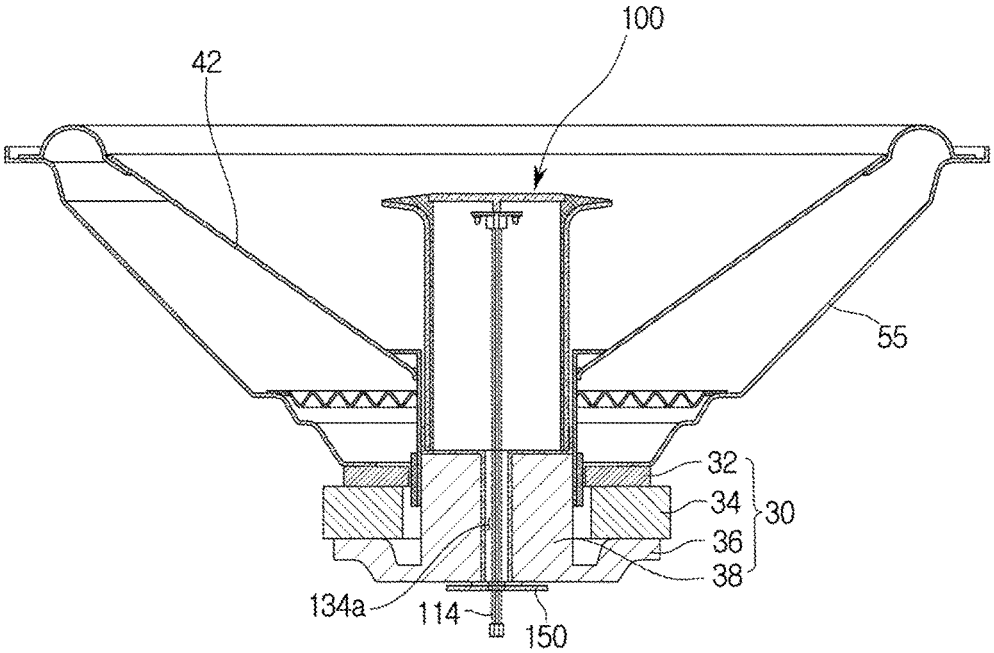
FIG. 4 is a cross sectional view which illustrates the speaker in accordance with an exemplary embodiment.
Figure 5A:
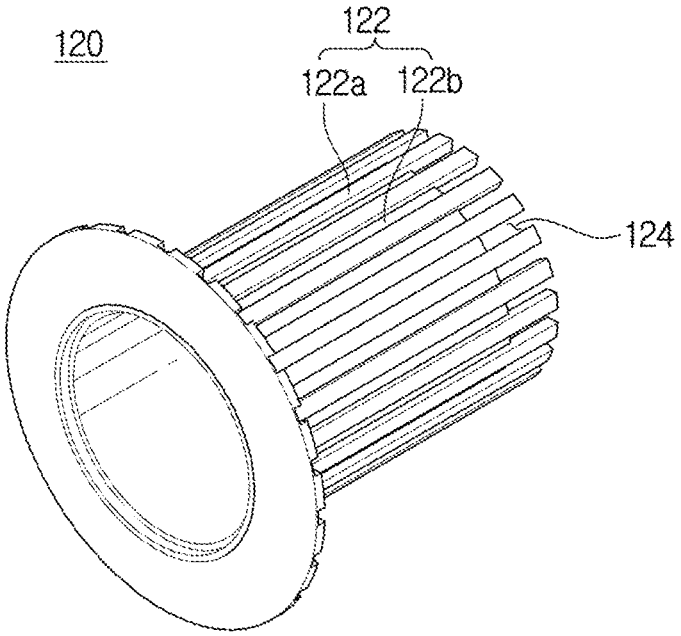
FIGS. 5A, 5B and 5C are views which illustrate a light diffusion portion in accordance with an exemplary embodiment.
Figure 5B:
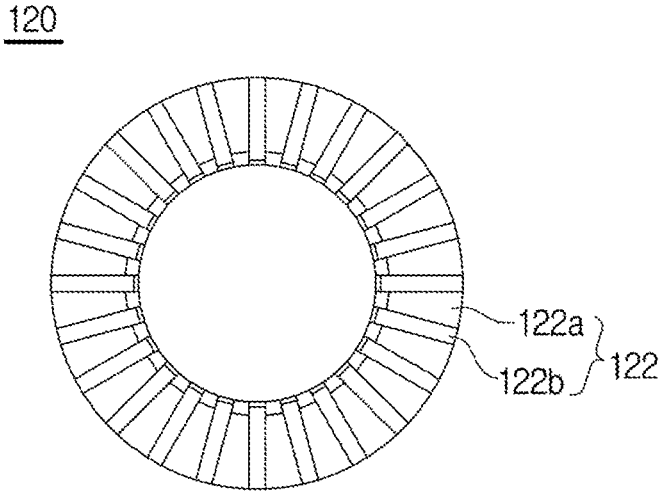
Figure 5C:
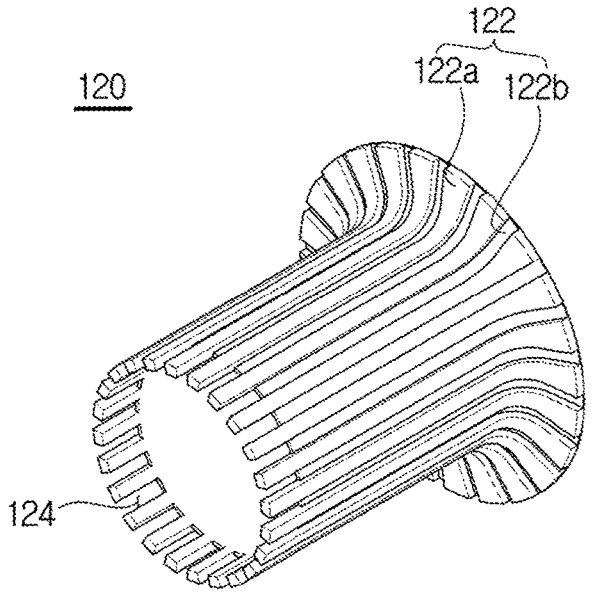
Figure 6A:
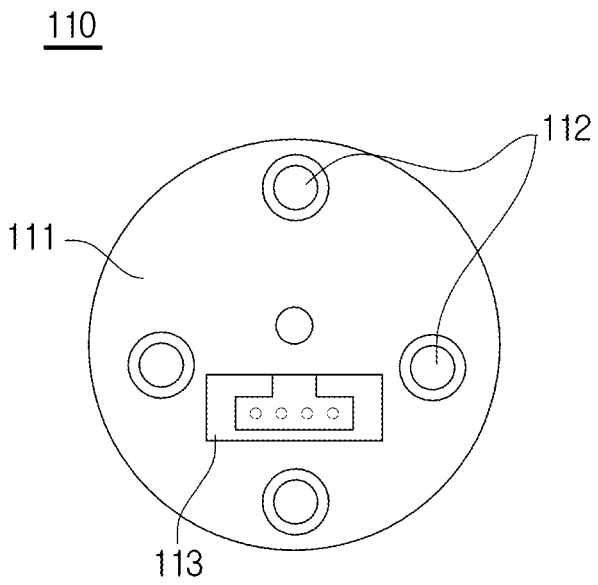
FIGS. 6A and 6B are views which illustrate a lighting module in accordance with an exemplary embodiment.
Figure 6B:
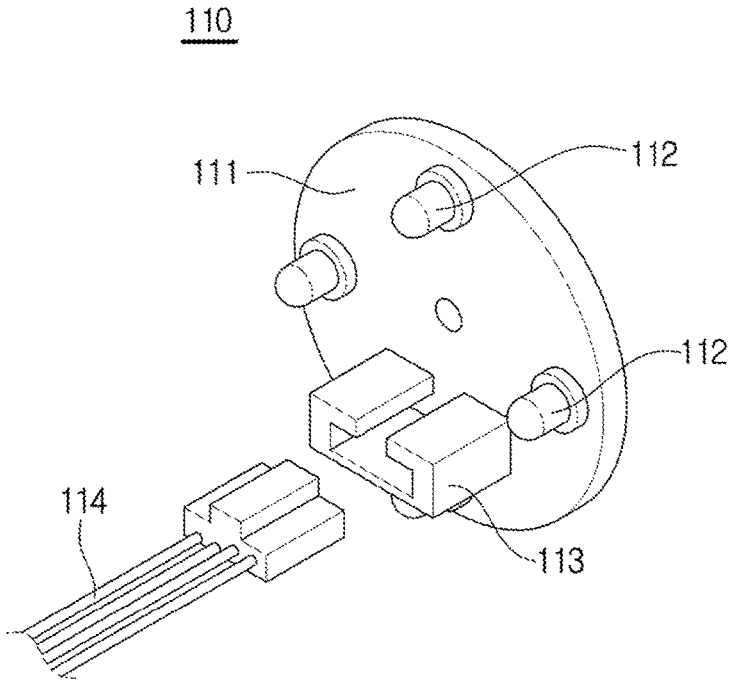

FIG. 1 is a perspective view illustrating a speaker in accordance with an exemplary embodiment. FIG. 2 is an exploded cross sectional view which illustrates the speaker in accordance with an exemplary embodiment. FIG. 3 is an exploded cross sectional view which illustrates the speaker in accordance with an exemplary embodiment. FIG. 4 is a cross sectional view illustrating the speaker in accordance with an exemplary embodiment, FIGS. 5A, 5B and 5C are views which illustrate a light diffusion portion in accordance with an exemplary embodiment, and FIGS. 6A and 6B are views which illustrate a lighting module in accordance with an exemplary embodiment.

The exemplary embodiments relate to a lighting apparatus 100 installed at a center of a speaker apparatus 20 such that light is dispersed to a vibration portion 42 of a speaker 10, and light motion is made according to the strength and weakness of an acoustic signal, thereby maximizing the visual effect.

The speaker 10 includes the speaker apparatus 20 and the lighting apparatus 100.

The speaker apparatus 20 is a portion which outputs sound generated from the speaker 10, and includes a magnetic circuit part 30, a vibration meter 40 and a frame 55.

The magnetic circuit part 30 is a portion to which an electrical signal is transmitted, such that sound is generated from speaker 10.

The magnetic circuit part 30 includes a magnet 34, an upper plate 32 provided at an upper side of the magnet 34, a lower plate 36 provided at a lower side of the magnet 34 and a pole piece 38 disposed at the center of the magnet 34.

The vibration meter 40 is a portion in which vibration is output from the acoustic signal, and the vibration member 40 includes a voice coil 46 provided in a gap 38*b* between the magnet 34 and the pole piece 38, a bobbin 44 on which the voice coil 46 is installed, a vibration portion 42 configured to be movable by a magnetic circuit formed by the magnetic circuit part 30, an edge 50 disposed between an end portion of the vibration portion 42 and the frame 55, and a spider 48 provided between the frame 55 and the bobbin 44.

The speaker apparatus 20 outputs sound in a way that electrical signals flow to the voice coil 46 of the bobbin 44 in response to input of an electrical signal, and the voice coil 46, laid in a magnetic field of the magnet 34, is subject to a force by Fleming's left hand rule, so that the vibration portion 42 coupled to the voice coil 46 vibrates.

The vibration portion 42 serves to transmit sound to the outside according to a varied vibration, depending on the sound, and is provided in a funnel shape or a cone shape having a center portion thereof which is concave. The shape of the vibration portion 42 is not limited thereto. The vibration portion 42 includes material capable of representing clearly displayed light radiated by the lighting apparatus 100, without scattering the light.

The lighting apparatus 100 is configured to radiate light toward the vibration portion 42 of the speaker 10 such that the intensity of light, the degree of dispersion, the light motion and the color of light are adjusted according to the strength and weakness of the acoustic signal, thereby maximizing the visual sound effect. The lighting apparatus 100 may be provided in different heights depending on the size of the vibration portion 42 of the speaker apparatus 20 such that light is dispersed over the entire area of the vibration portion 42.

The lighting apparatus 100 is insertedly disposed on a mounting part 60 provided at a center of the vibration portion 42 of the speaker apparatus 20. In particular, the lighting apparatus 100 is provided to be fixed to an upper portion of the pole piece 38.

The lighting apparatus 100 includes a lighting module 110 and a light diffusion portion 120.

The lighting module 110 includes a printed circuit board (PCB) 111 and at least one light emitting device 112 disposed on the PCB 111. The disposition of the light emitting devices 112 is not limited thereto, and according to the exemplary embodiments, the at least one of the light emitting devices 112 is disposed while being spaced apart from one another at a predetermined interval from a center of the PCB 111 in a outward direction of the PCB 111 so as to radiate uniform light to the vibration portion 42, and in a case when a plurality of the light emitting devices 112 are provided, the plurality of light emitting devices 112 are disposed while being spaced apart from one another by a predetermined interval.

The light emitting device 112 may have a single color or a plurality of colors, and may diffuse light in various directions. The light emitting device 112 may include a light emitting diode.

The light emitting device 112 may be disposed at a front surface or a rear surface of the vibration portion 42 of the speaker apparatus 20. In particular, although the light emitting device 112 is illustrated as being configured to emit light to the vibration portion 42, while being disposed at the front surface of the vibration portion 42, the exemplary embodiments are not limited thereto. According to other exemplary embodiments the light emitting device 112 is disposed at the rear surface of the vibration portion 42 in order to radiate light to the vibration portion 42 through a refraction member 126*a*.

The light emitting device 112 may be disposed on a virtual axis passing through the center of the vibration portion 42. Such a disposition of the light emitting device 112 at the center of the vibration portion 42 may enhance the lighting efficiency by radiating light to the vibration portion 42.

The PCB 111 includes a wire coupling 113 to which one side of a wire 114 is coupled to receive electrical signals from wire 114.

The wire 114 has the one side thereof connected to the wire coupling 13 of the PCB 111 and the other side thereof connected to an outside of the speaker apparatus 20 so as to transmit electrical signals to the PCB 111.

The light diffusion portion 120 is configured to surround the light module 110 in order to diffuse light generated from the lighting module 110 to the vibration portion 42. At least one portion of the light diffusion portion 120 includes light transmitting material to diffuse light generated from the lighting module 110 to the vibration portion 42.

The light diffusion portion 120 is provided in the form of a prism whose outer surface is curved to allow light generated from the lighting module 110 to diffuse or refract and then reach to the vibration portion 42.

In particular, the light diffusion portion 120 is provided in the form of a column having a hollow part, and has a concave convex part 122 formed at an outer surface thereof in a concave convex structure.

The concave convex part 122 includes a convex portion 122*a*, or protruding portion, protruding along an outer surface of the lighting diffusion part 120, and a concave portion 122*b* depressed when compared to the protrusion portion 122*a*, while being adjacent to the protrusion portion 122*a*.

The concave convex part 122 may be formed of transparent material to radiate light to the vibration portion 42 through scattering or refraction, due to the concave convex structure. Alternatively, the concave convex part 122 may have one of the convex portion 122*a* and the concave portion 122*b* formed to be opaque, and the remaining portion formed to be transparent. Preferably, the transparent portion and the opaque portion may be alternately disposed. The opaque portion may be manufactured by a dual injection or corrosion/surface treatment, but is not limited thereto.

At least one ventilation hole 124 may be provided in the concave convex part 122. In particular, the ventilation hole 124 is provided in the concave portion 122*b* so that heat generated from light emission of the light emitting device 112 at an inside of the light diffusion portion 120 is discharged to the outside.

The configuration of the light diffusion portion 120 is not limited thereto, and the external appearance of the light diffusion portion 120 may have various shapes and different colors.

A support 130 is configured to allow the light diffusion portion 120 to be mounted thereon while allowing a wire transmitting electrical signals to pass there through. The support 130 includes a fixing part 132 on which one side of the light diffusion portion 120 is fixedly mounted and a support hole passing through the fixing part 130 to guide the wire 114. The support 130 may be formed of material configured to withstand an increase of temperature created by the lighting apparatus 100 according to input of the voice coil 46 of the speaker apparatus 20. The support 130 may be formed of heat resistant material.

In addition, the support 130 also serves to allow the wire 114 and the light diffusion portion 120 to be spaced apart from the magnetic circuit part 30 and the vibration portion 42 such that the light diffusion portion 120 are the wire 115 are prevented from coming direct contact with the magnetic circuit part 30 and the vibration portion 42.

In addition, the fixing part 132 includes a mounting bottom part 132*a* provided in a disk shape and on which one side of the light diffusion portion 120 is mounted, and a mounting side part 132*b* provided to surround a lateral surface of the one side of the light diffusion portion 120.

A support tube 134 is a tube provided with a wire hole 134*a* allowing the wire 114 transmitting electrical signals to the light emitting device 112 to pass there through. The support tube 134 is configured to guide the wire 114 such that the wire 114 is connected to the outside while passing through the magnetic circuit part 30. The wire hole 134*a* may have a hollow shape extending to the fixing part 132.

In particular, the pole piece 38 is formed with a through hole 38*a* allowing the support tube 134 to pass there through. Accordingly, the support 130 to which the light diffusion portion 120 is fixed is mounted on the mounting part 60 while the support tube 134 of the support 130 is being inserted into the through hole 38*a*, and thus the wire 114 is guided without being damaged from heat generated from the magnetic circuit part 30 or the vibration portion 42.

A cover 140 is disposed at an outer end portion of the light diffusion portion 120 so as to prevent an inside of the lighting diffusion portion 120 from being exposed to the outside. The light diffusion portion 120 and the cover 140 may be separately provided from each other as individual units. Alternatively, the light diffusion portion 120 and the cover 140 may be integrally formed with each other to close one side of the hollow part of the light diffusion portion 120.

The cover 140 may be provided with a lighting module fixing portion 142 at a side thereof facing the inside of the light diffusion portion 120. The lighting module fixing portion 142 may be provided in varied lengths depending on the size of the vibration portion 42 of the speaker apparatus 20 such that the light generated from the lighting module 110 is dispersed in the overall area of the vibration portion 42 as the lighting module fixing portion 142 fixes the lighting module 110.

A cap 150 is provided at one end portion of the support tube 134 provided to pass through the pole piece, to fix the wire 114 passing through the wire hole 134*a* and close the wire hole 134*a*. The cap 150 may be fixed as a screw 152 is coupled to a screw groove (not shown) provided on the support tube 134, as illustrated. Alternatively, the cap 150 may be adhesively provided so as to be attached to an end portion of the support tube 134.

Hereinafter, the operation of the speaker having the above configuration will be described.

The lighting apparatus 100 is installed at the center portion of the speaker apparatus 20, and in response to an electric signal being applied to wire 114 of the lighting module 110, which is installed in the lighting apparatus 100, the light emitting device 112 is turned on. The light generated from the light emitting device 112 is radiated to the vibration portion 42 while being refracted or diffused depending, on the shape of the light diffusion portion 120.

In this case, light motion may be represented according to the strength and weakness of the vibration of the vibration portion 42 in the speaker apparatus 20; and the degree of light emission, motion of light and color of light may be adjusted according to the strength and weakness of the acoustic signal, thereby maximizing the visual sound effect.

Hereinafter, a speaker according to another exemplary embodiment will be described with reference to the accompanying drawing.

In the following description, details of parts identical to those of the previous exemplary embodiment will be omitted.

Figure 7:
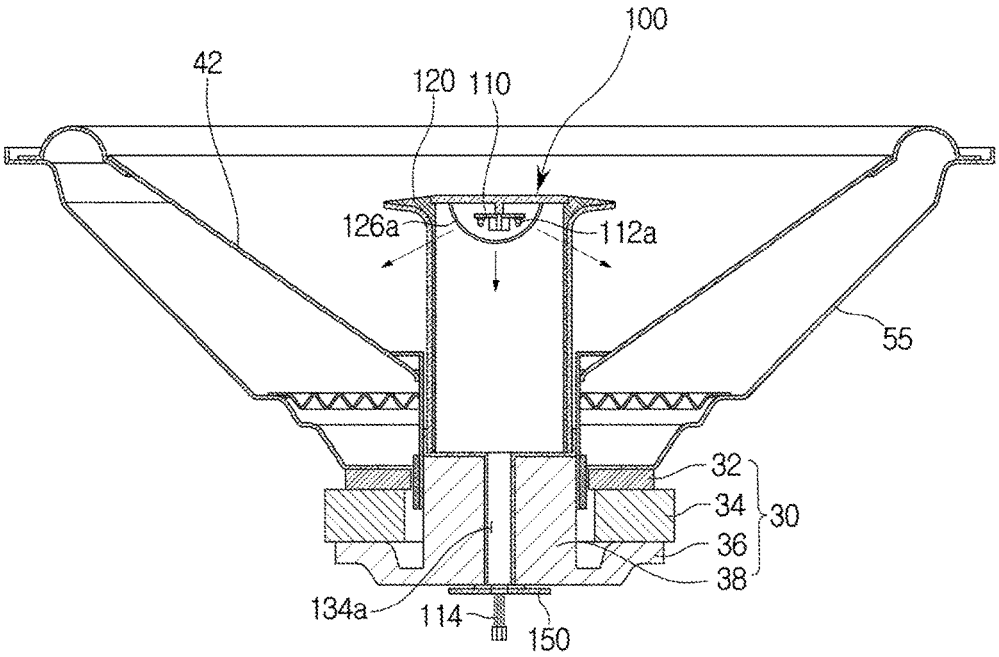
FIG. 7 is a view which illustrates a speaker in accordance with another exemplary embodiment.

FIG. 7 is a view illustrating a speaker in accordance with another exemplary embodiment.

Refraction members 126*a*, 126*b*, 126*c* and 126*d* (FIGS. 7-10) are configured to refract light radiated from the light emitting device 112 of the lighting module 110 in all directions, and has a protruding portion formed at a center thereof in a curved manner.

The refraction members 126*a*, 126*b*, 126*c* and 126*d* may have the protruding portion disposed in the same direction or the opposition direction of the radiation direction of the light emitting device 112 inside the light diffusion portion 120. In addition, depending on the situation, the refraction members 126*a*, 126*b*, 126*c* and 126*d* may be formed of lens-like material available for light transmission or mirror-like material for light reflection.

According to an exemplary embodiment, the refraction member 126*a* has the protruding portion disposed in the same direction as the light radiating direction of the light emitting device 112*a*, while covering the light emitting device 112*a*. In addition, the refraction member 126*a* may include light transmitting material.

According to such a configuration, light radiated from the light emitting device 112*a* is refracted by passing through the refraction member 126*a* to be emitted in a wider angle, so that light is emitted in a wide area of the vibration portion 42.

Figure 8:
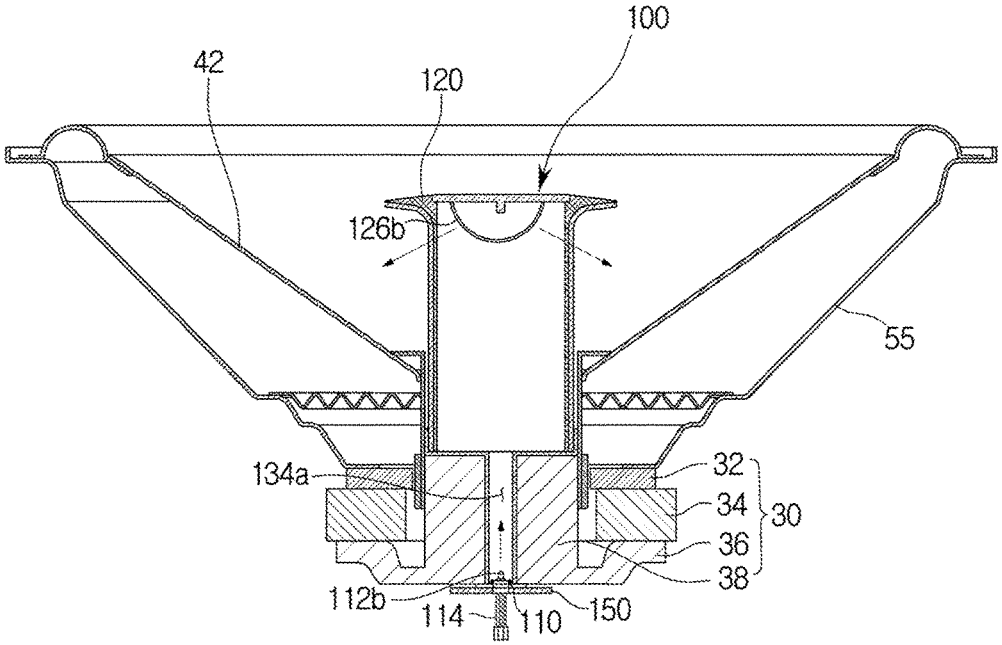
FIG. 8 is a view which illustrates a speaker in accordance with still another exemplary embodiment.

FIG. 8 is a view which illustrates a speaker in accordance with still another exemplary embodiment.

The refraction member 126*b* according to this exemplary embodiment may have a protruding portion disposed in the opposite direction to the radiation direction of a light emitting device 112*b* and may be formed of light reflection material. The lighting module 110 on which the light emitting device 112*b* is positioned is disposed at an end portion of the support tube 134 so as to radiate light to the inside of the light diffusion portion 120 through the wire hole 134*a* of support tube 134.

The refraction member 126*b* is disposed at one surface inside of the light diffusion portion 120 of the cover 140, and light emitted may be reflected by the refraction member 126*b*, and after passing through the light diffusion portion 120, radiated to the vibration portion 42.

Figure 9:
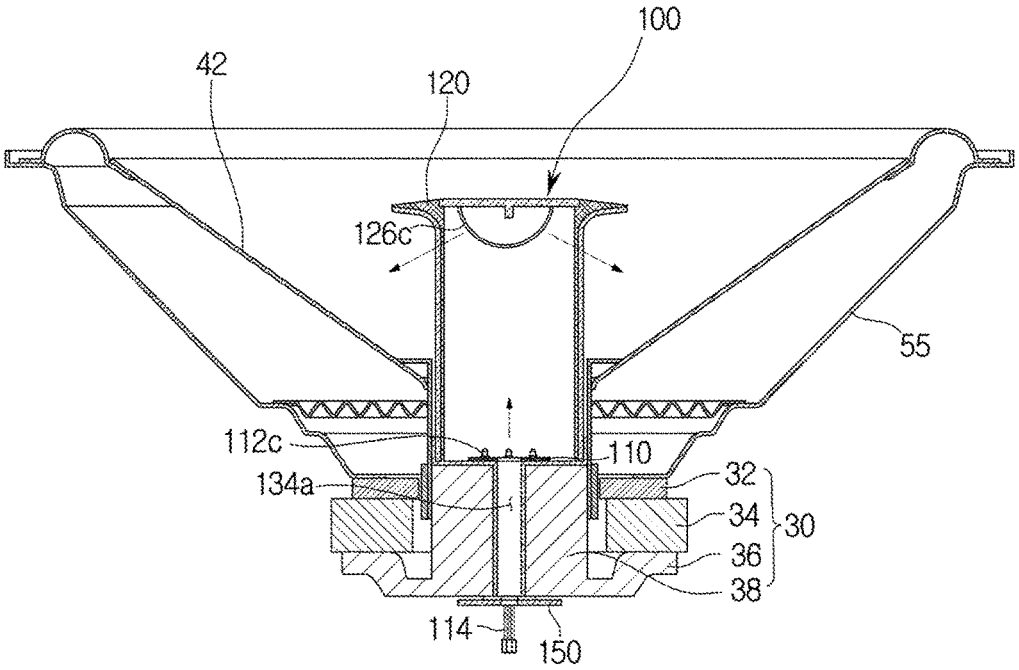
FIG. 9 is a view which illustrates a speaker in accordance with still another exemplary embodiment.

FIG. 9 is a view which illustrates a speaker in accordance with still another exemplary embodiment.

The refraction member 126*c*, according to this exemplary embodiment may have a protruding portion disposed in the opposite direction to the radiation direction of a light emitting device 112*c* and may be formed of light reflection material. The lighting module 110 on which the light emitting device 112*c* is disposed adjacent to the support 130 at an inside the light diffusion portion 120, and the refraction member 126*c* may be disposed at one surface of the inside of the light diffusion portion 120 of the cover 140.

That is, the refraction member 126*c* may be disposed at one side of the light diffusion portion 120, and the light emitting device 112*c* may be disposed at the other side of the light diffusion portion 120.

According to such a configuration, light radiated from the light emitting device 112*c* is reflected by the refraction member 126*b*, and after passing through the light diffusion portion 120, is radiated to the vibration portion 42.

Figure 10:
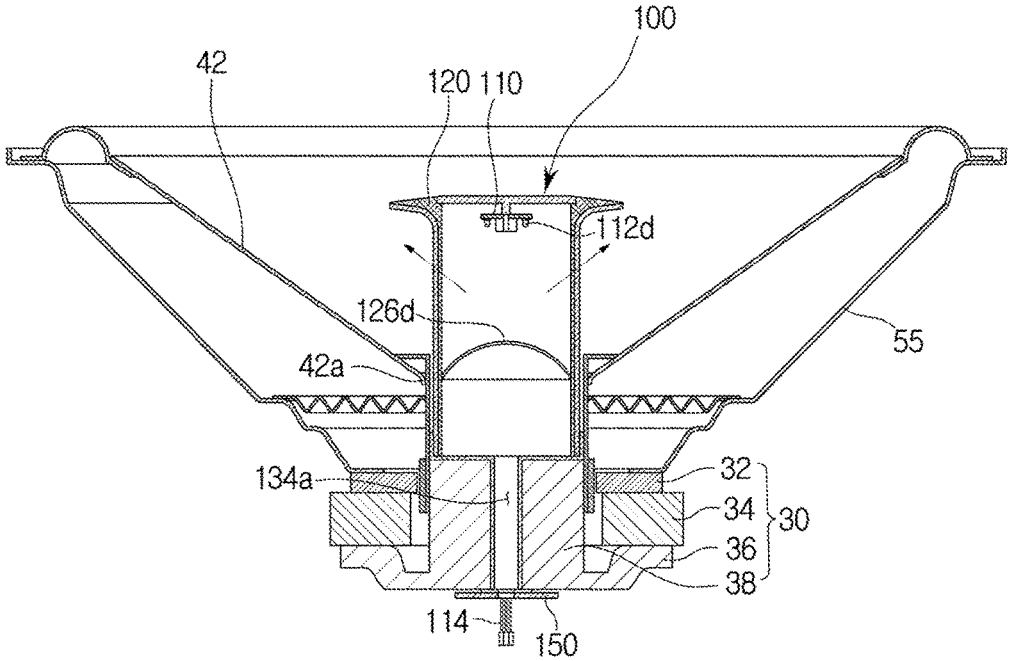
FIG. 10 is a view which illustrates a speaker in accordance with still another exemplary embodiment.

FIG. 10 is a view which illustrates a speaker in accordance with still another exemplary embodiment.

The refraction member 126*d*, according to this exemplary embodiment may have a protruding portion disposed in a direction opposite to the radiation direction of a light emitting device 112*d* and may be formed of light reflection material. The lighting module 110 on which the light emitting device 112*c* is positioned at an inner side of cover 140.

The refraction member 126*d* may be disposed at a height which corresponds to the middle portion 42*a* of the vibration portion 42.

According to such a configuration, light radiated from the light emitting device 112*d* is reflected by refraction member 126*d*, and after passing through the light diffusion portion 120, is radiated to the vibration portion 42.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. A speaker comprising:

a speaker apparatus configured to generate sound and provided with a coned shaped vibration portion; and a lighting apparatus inserted through the vibration portion and disposed at a center of the vibration portion to emit light to the vibration portion, wherein the lighting apparatus comprises:

a lighting module having a light emitting device; and a light diffusion portion that surrounds the lighting module and is configured to diffuse light generated from the light module toward the vibration portion, a cover located at a top portion of the light diffusion portion that covers an interior thereof, wherein a first end portion of the lighting apparatus is inserted through the vibration portion, wherein the lighting module is disposed at a second end portion opposite to the first end of the lighting apparatus, and wherein the lighting module is attached to a center portion of the cover, and arranged inside the light diffusion portion.

2. The speaker of claim 1, further comprising a light mounting portion provided on the center of the vibration portion, wherein the lighting apparatus is mounted on the light mounting portion.

3. The speaker of claim 1, wherein the light diffusion portion comprises a prism comprising a curved outer surface configured to allow light generated from the lighting module to reach the vibration portion through dispersion or refraction.

4. The speaker of claim 1, wherein the light diffusion portion comprises a concave convex part provided in a column shape on an outer surface of the light diffusion portion formed in a convex structure.

5. The speaker of claim 4, wherein the concave convex part comprises a ventilation hole provided at an inner side of the concave convex part and configured to radiate heat generated by the light emitting device.

6. The speaker of claim 1, wherein the lighting apparatus further comprises:

a support configured to have a lower portion of the light diffusion portion mounted thereon, the support configured to be mounted and fixed to the center of the vibration portion.

7. The speaker of claim 1, wherein the lighting apparatus further comprises a refraction member provided at an inside the light diffusion portion, the refraction member having a center thereof which protrudes while having a curved surface so as to diffuse light generated from the lighting module toward the vibration portion.

8. A speaker comprising:

a magnetic circuit part forming a magnetic circuit, the magnetic circuit comprising a magnet, an upper plate provided at an upper side of the magnet, a lower plate provided at a lower side of the magnet and a pole piece disposed in a center of the magnet;

a vibration meter configured to be movable by the magnetic circuit formed by the magnetic circuit part, the vibration meter comprising a voice coil provided between the magnet and the pole piece to interact with the magnetic circuit part, a bobbin on which the voice coil is installed and which moves in an axial direction, and a vibration portion configured to generate sound by generating vibration from movement of the bobbin; and a lighting apparatus insertedly installed in a center of the vibration portion so as to radiate light to the vibration portion, wherein the lighting apparatus comprises:

a lighting module having a light emitting device; and a light diffusion portion that surrounds the lighting module and is configured to diffuse light generated from the light module toward the vibration portion, a cover located at a top portion of the light diffusion portion that covers an interior thereof, wherein a first end portion of the lighting apparatus is inserted through the vibration portion, wherein the lighting module is disposed at a second end portion opposite to the first end of the lighting apparatus, and wherein the lighting module is attached to a center portion of the cover, and arranged inside the light diffusion portion.

9. The speaker of claim 8, wherein the lighting apparatus is fixedly mounted on an upper portion of the pole piece.

10. The speaker of claim 8, wherein the light diffusion portion has a concave convex part provided with a concave convex structure formed at a circumference thereof, the light diffusion portion provided in a cylindrical form having a hollow portion.

11. The speaker of claim 10, wherein the lighting apparatus further comprises a support comprising a fixing part to which one side of the light diffusion portion is fixedly mounted, and a support tube inserted into a through hole provided in the pole piece and having a wire hole which corresponds to the hollow portion of the light diffusion portion extending to the fixing part so as to allow a wire transmitting an electrical signal to the lighting module to pass there through.

12. A speaker comprising:

a speaker apparatus configured to generate sound and provided with a vibration portion; and a lighting apparatus inserted through the vibration portion and disposed at a center of the vibration portion to emit light to the vibration portion, wherein the lighting apparatus comprises:

a lighting module having a light emitting device; and a light diffusion portion configured to surround the lighting module in order to diffuse light generated from the light module toward the vibration portion, wherein the light diffusion portion is configured to allow light generated from the lighting module to reach the vibration portion through dispersion or refraction, wherein a first end portion of the lighting apparatus is inserted through the vibration portion, wherein the lighting module is disposed at a second end portion opposite to the first end of the lighting apparatus, and wherein the lighting apparatus further comprises a refraction member provided at the second end of the lighting apparatus and formed in a hemispherical shape covering the light emitting device, and refracting light from the light emitting device emitted toward the refraction member.

13. The speaker of claim 12, wherein the vibration portion of the speaker apparatus is cone shaped.

14. The speaker of claim 12, wherein the light diffusion portion comprises a prism with a curved outer surface.

15. The speaker of claim 12, wherein the light diffusion portion comprises a concave convex part provided in a column shape.

16. The speaker of claim 15, wherein one of the convex portion and the concave portion is opaque and the other of the convex portion and the concave is transparent.

17. The speaker of claim 1, wherein an end portion of the light diffusion portion along an axial direction of the lighting apparatus is bent to protrude outwardly in a radial direction of the lighting apparatus.

18. The speaker of claim 8, wherein an end portion of the light diffusion portion along an axial direction of the lighting apparatus is bent to protrude outwardly in a radial direction of the lighting apparatus.

19. The speaker of claim 12, wherein an end portion of the light diffusion portion along an axial direction of the lighting apparatus is bent to protrude outwardly in a radial direction of the lighting apparatus.

* * * * *